US009788121B2

(12) United States Patent
Jiang et al.

(10) Patent No.: US 9,788,121 B2
(45) Date of Patent: Oct. 10, 2017

(54) FLAT PLATE-TYPE BASS LOUDSPEAKER

(71) Applicant: GOERTEK INC., Shandong (CN)

(72) Inventors: Chao Jiang, Shandong (CN); Jianbin Yang, Shandong (CN); Zhi Li, Shandong (CN); Qijin Jiao, Shandong (CN)

(73) Assignee: GOERTEK INC., Shandong (CN)

( * ) Notice: Subject to any disclaimer, the term of this patent is extended or adjusted under 35 U.S.C. 154(b) by 0 days.

(21) Appl. No.: 14/889,703

(22) PCT Filed: May 31, 2013

(86) PCT No.: PCT/CN2013/076556

§ 371 (c)(1),
(2) Date: Nov. 6, 2015

(87) PCT Pub. No.: WO2014/180015

PCT Pub. Date: Nov. 13, 2014

(65) Prior Publication Data

US 2016/0080869 A1 Mar. 17, 2016

(30) Foreign Application Priority Data

May 8, 2013 (CN) ..... 2013 1 0167142
May 8, 2013 (CN) ..... 2013 2 0245270 U

(51) Int. Cl.
*H04R 9/06* (2006.01)
*H04R 7/04* (2006.01)
(Continued)

(52) U.S. Cl.
CPC ..... *H04R 7/04* (2013.01); *H04R 1/2803* (2013.01); *H04R 7/02* (2013.01); *H04R 9/025* (2013.01);
(Continued)

(58) Field of Classification Search
CPC ..... H04R 7/04; H04R 9/063
See application file for complete search history.

(56) References Cited

U.S. PATENT DOCUMENTS 1,872,799 A * 8/1932 Pare ..... H04R 9/063 181/147
4,122,314 A * 10/1978 Matsuda ..... H04R 7/02 181/170
(Continued)

FOREIGN PATENT DOCUMENTS

CN 201657302 U 11/2010
CN 201667712 U 12/2010
(Continued)

OTHER PUBLICATIONS

State Intellectual Property Office of the People's Republic of China, Notification of First Office Action, dated May 29, 2015, 6 pages.
(Continued)

*Primary Examiner* — Maria El-Zoobi
*Assistant Examiner* — Ryan Robinson
(74) *Attorney, Agent, or Firm* — Holzer Patel Drennan

(57) ABSTRACT

A flat plate bass loudspeaker comprising a flat plate diaphragm, at least three driving units and a housing. The driving unit comprises a voice coil unit and a magnetic circuit unit; the voice coil units are dispersedly coupled to one side of the diaphragm near the housing; mounting holes for accommodating and fixing the magnetic circuit units, and voice outlet holes penetrating through the housing are arranged on the housing; the number and position of the mounting holes are corresponding to those of voice coils attached to the spherical top of the diaphragm; and ratio of the total area of the voice outlet holes to the orthographic projection area of the diaphragm on the housing is in a range less than 0.9. The flat plate bass loudspeaker provided by the
(Continued)

present invention can avoid the problems occurred in thick and heavy voice coils and excessive magnet performance.

9 Claims, 7 Drawing Sheets

(51) Int. Cl.
*H04R 7/02* (2006.01)
*H04R 1/28* (2006.01)
*H04R 9/04* (2006.01)
*H04R 9/02* (2006.01)

(52) U.S. Cl.
CPC ..... *H04R 9/041* (2013.01); *H04R 9/045* (2013.01); *H04R 9/063* (2013.01)

(56) References Cited

U.S. PATENT DOCUMENTS 4,252,211 A * 2/1981 Matsuda ..... H04R 1/22 181/166
4,899,390 A * 2/1990 Takewa ..... H04R 1/2834 181/145
6,836,552 B1 * 12/2004 Bachmann ..... H04R 7/06 381/152
6,929,091 B2 * 8/2005 Bertagni ..... H04R 1/02 181/150
9,277,323 B2 * 3/2016 Locke ..... H04R 7/04

FOREIGN PATENT DOCUMENTS

| | | | |
|---|---|---|---|
| CN | 201789621 | | 4/2011 |
| CN | 201789621 | U | 4/2011 |
| CN | 202111850 | U | 1/2012 |
| CN | 202310089 | U | 7/2012 |
| CN | 201310167142.2 | | 4/2013 |
| CN | 203279158 | U | 11/2013 |
| KR | 10-2015-7034779 | | 4/2013 |
| WO | 2010050068 | A1 | 5/2010 |

OTHER PUBLICATIONS

State Intellectual Property Office of the People's Republic of China, International Search Report, dated Feb. 27, 2015, 7 pages.
Office Action from Korean Intellection Property Office, Application 10-2015-7034779.
Office Action ($4^{th}$) dated Feb. 20, 2017 from corresponding Chinese application No. 201310167142.2.

* cited by examiner

FLAT PLATE-TYPE BASS LOUDSPEAKER

CROSS-REFERENCE TO RELATED APPLICATIONS

The present application claims benefit of priority to PCT Application No. PCT/CN2013/076556, entitled "FLAT PLATE-TYPE BASS LOUDSPEAKER" and filed on 31 May 2013, which is specifically incorporated by reference herein for all that it discloses or teaches. The present application claims further benefit of priority to Chinese Application Nos. 2013/10167142.2 and 2013/20245270.X, both of which were filed 8 May 2013 and are specifically incorporated by reference herein for all that they disclose or teach.

TECHNICAL FIELD

The present invention relates to the technical field of electro-acoustic and, more specifically, to a flat plate-type bass loudspeaker.

BACKGROUND

Along with the social progress and technical development, electronic products such as a TV are smaller in size and gradually thinned in recent years. User's demands are higher and higher to the performance of these electronic products. Thus, the matching electronic parts are required to be smaller in size and thickness and improved in performance and consistency.

A traditional bass loudspeaker usually adopts a paper cone vibration diaphragm. The cone vibration diaphragm comprises a voice coil at the central region thereof, and the magnetic circuit system is relatively large and thick. The bass loudspeaker with such a configuration is too thick to meet the requirement of gradually-thinned electronic products, and it has poor practicability.

Besides, the bass loudspeaker usually has a larger diameter (i.e. larger area of vibration diaphragm) to ensure the low-frequency sound effect. If a flat plate-shaped vibration diaphragm is adopted, combining a voice coil (the voice coil is required to be positioned near the edge), the vibration diaphragm with larger area requires the voice coil to be large in size, causing difficult winding and easy deformation. Further, the existing bass loudspeaker is large in magnet size. However, washers and frames are required to be smaller during thinned application. The magnetic circuit system is easy to be saturated, and the magnet performance is excessive, leading to waste and relatively high cost.

Based on the above reasons, there is a need to improve the structures of a traditional bass loudspeaker to avoid the afore-mentioned defects.

SUMMARY

In view of the above problems, the present invention aims to provide a flat plate-type bass loudspeaker to realize thinning of bass loudspeakers and solve the problems of thick and heavy voice coils and excessive magnet performance.

The present invention provides a flat plate-type bass loudspeaker, comprising a flat plate-shaped vibration diaphragm, at least three driving units independent from each other and a housing for fixing and combining the vibration diaphragm and the driving units; wherein, the driving unit comprises a voice coil unit and a magnetic circuit unit corresponding to the voice coil unit, the voice coil units are separately combined and fixed at one side of the vibration diaphragm closer to the housing; mounting holes for accommodating and fixing the magnetic circuit units, and sound holes penetrating through the housing and communicated with outside are arranged on the housing; besides, the number and positions of the mounting holes are corresponding to the number and positions of voice coils attached to the dome part of the vibration diaphragm; a ratio of total area of the sound holes to area of the orthographic projection of the vibration diaphragm on the housing is less than 0.9.

Additionally, the preferred scheme is that, the vibration diaphragm is rectangle in shape, comprising a rigid dome part at the central region and a folding ring part at the edge region; the voice coil units are fixed and combined to the dome part.

Additionally, the preferred scheme is that, the housing comprises a mounting plane and an annular side wall arranged surrounding the mounting plane; the mounting holes and the sound holes are arranged on the mounting plane; the upper side of the annular side wall is coupled to the folding ring part of the vibration diaphragm.

Additionally, the preferred scheme is that, the number of the driving units is four or six, wherein, at each of four corners of the dome part is disposed one of the voice coil units, respectively; and the ratio of total area of the sound holes to area of the orthographic projection of the vibration diaphragm on the housing is in a numerical range of 0.2 to 0.6.

Additionally, the preferred scheme is that, the sound holes comprise a central sound hole arranged at the central region of the mounting plane and an edge sound hole arranged at the edge region of the mounting plane; and area of the central sound hole is larger than that of the edge sound hole.

Additionally, the preferred scheme is that, further comprising a FPCB connector electrically connecting an internal circuit and an external circuit of the bass loudspeaker, wherein, when the number of the driving units is four, the FPCB connector is T-shaped, clamped and fixed on the mounting plane at the edge of the central sound hole, one part of the FPCB connector is positioned at a side of the mounting plane closer to the vibration diaphragm, and another part of the FPCB connector is positioned at a side of the mounting plane away from the vibration diaphragm.

When the number of the driving units is six, the FPCB connector has an elongated shape, the middle part of the FPCB connector is coupled to a side of the vibration diaphragm with the voice coils disposed, and two end parts of the FPCB connector extend to a side of the mounting plane away from the vibration diaphragm through the edge sound hole.

Additionally, the preferred scheme is that, when the number of the driving units is six, the central sound hole is circular or square in shape, arranged between every four adjacent mounting holes; and the edge sound hole has an elongated shape, arranged between four sides of the annular side wall and the mounting holes, respectively.

Additionally, the preferred scheme is that, the folding ring part is made of PU or silicon rubber; and the housing is made of aluminum alloy material.

Additionally, the preferred scheme is that, the periphery of the annular side wall is further provided with an extension part on which fixing holes for fixing the loudspeaker are uniformly arranged.

Additionally, the preferred scheme is that, the voice coil unit comprises a centering sheet, a voice coil bobbin and a voice coil; and the upper surface of the mounting plane is provided with a position limiting part for limiting the centering sheet.

It can be seen from the above technical scheme that, the flat plate-type bass loudspeaker of the invention can achieve the following beneficial effects: at least three driving units are included, and using small-size voice coil units and magnetic circuit units to drive large-size vibration diaphragm of the bass loudspeaker, thus thickness of the bass loudspeaker and the size of magnets can be reduced, reducing cost and improving the sensitivity of the loudspeaker; besides, the configuration that the driving units are arranged at the corner is beneficial to driving the vibration diaphragm of the bass loudspeaker in equilibrium; as the central part of the vibration diaphragm generates more airflow, the ratio of total area of sound holes to area of the orthographic projection of the vibration diaphragm on the housing is less than 0.9, which is beneficial to smoothness of air flowing and can improve the acoustic performance; the housing adopts aluminum alloy materials which have high strength and good stability; the voice coil and the external circuit are connected by using FPCB (Flexible Printed Circuit Board, short for FPCB or FPC), which is space-saving.

In order to achieve the above and other related objectives, one or more aspects of the present invention include those features to be described in detail in the followings and particularly pointed out in the claims. Some exemplary aspects of the present invention are described in details by the description below and the accompanying drawings. However, these aspects only indicate some implementations of various implementations of the present invention. In addition, the present invention intends to include all these aspects and their equivalents.

BRIEF DESCRIPTIONS OF THE DRAWINGS

Through the descriptions referring to the accompanying drawings and the claims, based on a full understanding of the present invention, other purposes and results of the present invention will be more clearly and easily understand.

Figure 1:
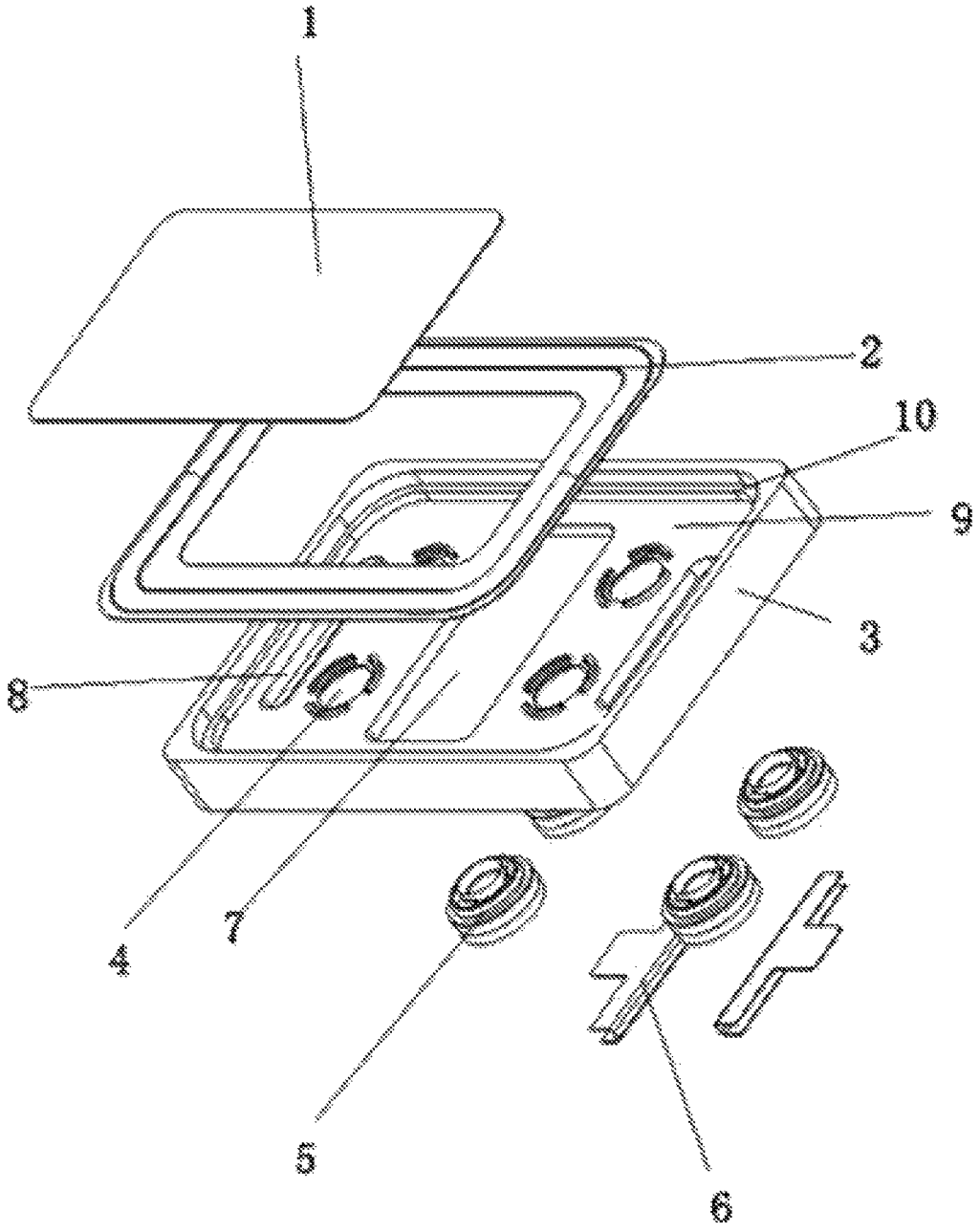
FIG. 1 is a structural schematic diagram of four driving units of the flat plate-type bass loudspeaker according to the first embodiment of the present invention.

The reference numbers in the appended drawings: dome part 1, folding ring part 2, housing 3, mounting hole 4, driving unit 5, FPCB connector 6, central sound hole 7, edge sound hole 8, mounting plane 9, annular side wall 10, voice coil 11, voice coil bobbin 12, centering sheet 13, washer 14, magnet 15, T-shaped iron 16, magnetic gap 17, vibration diaphragm 18, rear acoustic cavity 19.

Similar signs indicate similar or corresponding features or functions throughout the drawings.

DETAILED DESCRIPTIONS

Various specific details are set forth in the following description to provide comprehensive understanding for one or more embodiments for sake of illustration. However, it is obvious that these embodiments can be implemented without such specific details. Particular embodiments of the present invention are described in connection with the accompanying drawings.

The bass loudspeaker needs a large area of the vibration diaphragm. In order to provide enough driving force for the large-area vibration diaphragm while limiting the size of voice coils and magnets, in the present invention, multiple driving units which are independent from each other are separately disposed, so that the vibration diaphragm is driven by multiple independent voice coils and each voice coil corresponds to an independent magnetic circuit unit, thereby realizing thinning of the bass loudspeaker through more suitable and effective driving unit arrangements.

The flat plate-type bass loudspeaker of the present invention comprises a flat plate-shaped vibration diaphragm, at least three driving units independent from each other and a housing made of aluminum alloy materials. The housing is used for fixing and combining the vibration diaphragm and the driving units. Besides, the driving units independent from each other are dispersedly arranged to drive the vibration diaphragm in equilibrium so that the vibration diaphragm can vibrate in equilibrium.

Wherein, the vibration diaphragm has wide-diameter, that is, the vibration diaphragm has a large area, so that the low-frequency sound effect of the products can be ensured. In the following exemplary illustration of a specific embodiments, the vibration diaphragm is of a rectangular shape but it does not limited to such an configuration (for example, round shape can be used). The vibration diaphragm comprises a rigid dome part at the central region thereof and a folding ring part at the edge region thereof. The dome part and the folding ring part can be fixed and combined by adhesive bonding and the like. The driving unit comprises a voice coil unit and a magnetic circuit unit corresponding to the voice coil unit. The voice coil units are attached to and fixed on the dome part of the vibration diaphragm.

The housing comprises a mounting plane and an annular side wall surrounding periphery of the mounting plane. Mounting holes for accommodating and fixing the magnetic circuit units, and sound holes penetrating through the mounting plane are arranged on the mounting plane. The upper side of the annular side wall is fixedly connected with the folding ring part of the vibration diaphragm, wherein, the number and positions of the mounting holes are corresponding to those of voice coils attached to the dome part of the vibration diaphragm.

The voice coil unit is electrically connected with the external circuit through a FPCB connector, that is, the FPCB connector is used for electrically connecting the internal circuit and external circuit of the bass loudspeaker.

FIG. 1 is a structural schematic diagram of four driving units of the flat plate-type bass loudspeaker according to the first embodiment of the present invention. As shown in FIG. 1, the flat plate-type bass loudspeaker of the first embodiment comprises a vibration diaphragm, four driving units 5 and a housing 3.

The vibration diaphragm comprises a rigid dome part 1 at the central region thereof and a folding ring part 2 at the edge region thereof. The driving unit 5 comprises a voice coil unit and a magnetic circuit unit. Each voice coil unit is corresponding to a magnetic circuit unit, respectively. The housing 3 comprises a mounting plane 9 at the central region thereof and an annular side wall 10 surrounding the periphery of the mounting plane. The upper side of the annular side wall 10 is combined with the folding ring part 2 of the vibration diaphragm.

Also, fixing holes (not shown in FIG. 1) can be disposed at the edge of the annular side wall to facilitate the fixation of the flat plate-type bass loudspeaker and combination of the flat plate-type bass loudspeaker with electronic devices. The fixing holes can be arranged at one side of the annular side wall away from the vibration diaphragm. Also, a annular extension part can be added on the periphery of the annular side wall and the fixing holes are uniformly arranged on the extension part.

The flat plate-type bass loudspeaker shown in FIG. 1 comprises four driving units which are coupled to four corners of the dome part 1 of the vibration diaphragm, respectively.

Mounting holes 4 and sound holes penetrating through the mounting plane are arranged on the mounting plane 9. The number and positions of mounting holes 4 correspond to those of the driving units. The mounting holes 4 are used for accommodating the voice coil units and mounting and fixing the magnetic circuit units. A position limiting part for limiting the position of a centering sheet is arranged in the mounting hole 4 on the mounting plane 9. The mounting holes 4 can be used for mounting and fixing the magnetic circuit units.

The sound holes comprise a central sound hole 7 and an edge sound hole 8. The central sound hole 7 is arranged at the central region of the mounting plane 9, corresponding to the intermediate region of the vibration diaphragm. The edge sound hole 8 is arranged in the edge region of the mounting plane 9, i.e., between the annular side wall 10 and the mounting holes 4. Relative to the whole mounting plane, the edge sound hole 8 is arranged on the edge parallel to the central sound hole 7. To ensure that the airflow generated at the central region of the vibration diaphragm is more than the airflow generated at the edge region of the vibration diaphragm so that airflow on both sides of the housing 3 can circulate smoothly, the size of the central sound hole is larger than the size of the edge sound hole. Besides, the sound hole should be arranged away from the mounting holes 4 and maintains certain spacing distance to ensure the strength of the housing 3.

Besides, the ratio of total area of the sound holes to area of the orthographic projection of the vibration diaphragm on the housing is in a numerical range of less than 0.9 to improve the smoothness of airflow and enhance the acoustic performance of the bass loudspeaker. Wherein, the orthographic projection area of the vibration diaphragm on the housing is the orthographic projection area of the vibration diaphragm in the direction perpendicular to the vibration direction thereof. Such a configuration can ensure the smoothness of airflow as well as the performances (such as strength and heat dissipation) of the housing.

For rectangular vibration diaphragm, the intermediate region of the vibration diaphragm is relatively large and the airflow generated on this part of vibration diaphragm is more, therefore, central sound hole 7 is arranged on the mounting plane 9 corresponding to this part. Besides, the size of the central sound hole 7 is relatively large so that more airflow flows in or out from the central sound hole 7.

In the embodiment shown in FIG. 1, the edge sound hole 8 has an elongated shape and arranged on the mounting plane parallel to the central sound hole 7. Of course, the edge sound holes can be designed to be round or other irregular shapes according to the application requirement of the loudspeaker.

The upper side of the annular side wall 10 is fixedly connected with the folding ring part 2 of the vibration diaphragm.

Four driving units 5 of the embodiment shown in FIG. 1 are electrically connected by the FPCB connector 6. In the present embodiment, the FPCB connector 6 is T-shaped, clamped and fixed on the mounting plane 9 closing to the edge of the central sound hole 7. Multiple welding pads (not shown in FIG. 1) are arranged on the FPCB connector 6. The welding pads are connected with the voice coils and the external circuit.

As the FPCB connector 6 is clamped and fixed on the mounting plane, one part of the FPCB connector is positioned at one side of the mounting plane 9 near the vibration diaphragm, and other part of the FPCB connector is positioned at one side of the mounting plane 9 away from the vibration diaphragm. The driving units 5 and the FPCB connector 6 are electrically connected at one side closing to the vibration diaphragm.

Figure 2:
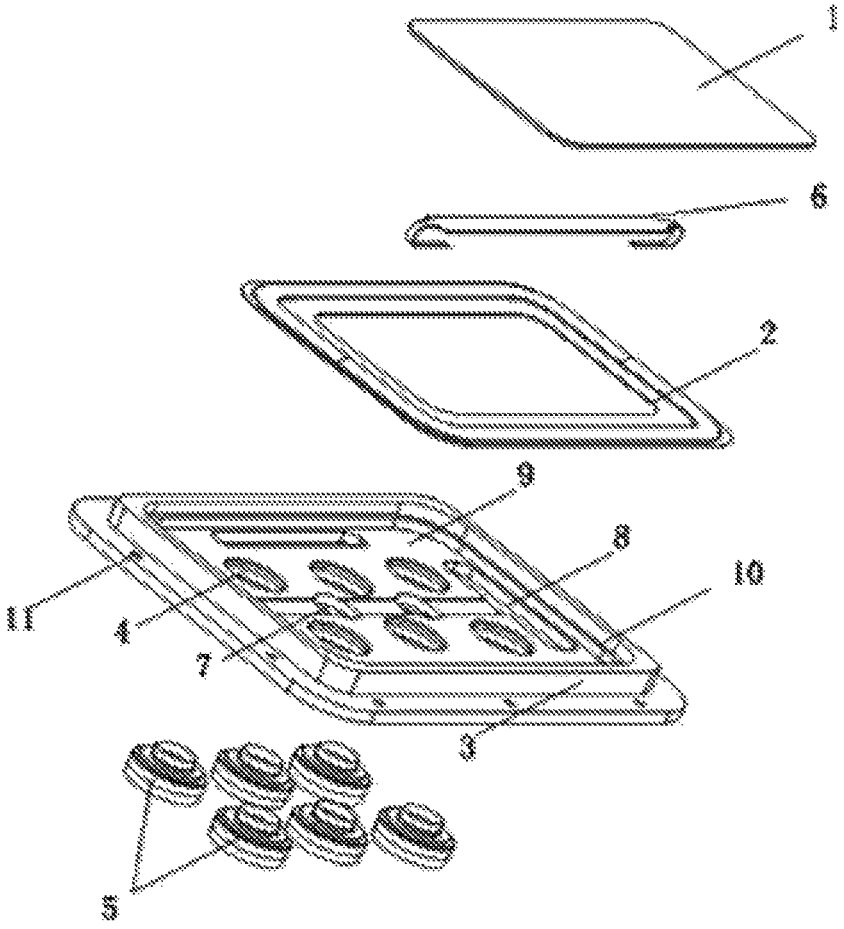
FIG. 2 is a structural schematic diagram of six driving units of the flat plate-type bass loudspeaker according to the second embodiment of the present invention.

Also, the flat plate-type bass loudspeaker can comprise six driving units. FIG. 2 is a structural schematic diagram of six driving units of the flat plate-type bass loudspeaker according to the embodiment of the present invention. As shown in FIG. 2, the flat plate-type bass loudspeaker comprises a vibration diaphragm, six driving units 5 independent from each other and a housing 3.

The flat plate-type bass loudspeaker comprises six driving units, four driving units of which are arranged at four corners of the dome part of the vibration diaphragm respectively, and the rest two voice coil units are respectively arranged on one or two groups of opposite sides formed by the voice coil units at four corners, and arranged at equal interval with two voice coils on the sides, so as to form larger driving force to act on electronic devices with higher power.

The housing 3 comprises a mounting plane 9 and an annular side wall 10 surrounding the mounting plane. Fixing holes (not shown in FIG. 2) are arranged at the edge of the annular side wall. The fixing holes are used for fixing the flat plate-type bass loudspeaker and combination of the flat plate-type bass loudspeaker and electronic devices. In the embodiment shown in FIG. 2, the periphery of the annular side wall is provided with an extension part on which fixing holes for fixing the loudspeaker are uniformly arranged.

Mounting holes 4 and sound holes penetrating through the mounting plane are arranged on the mounting plane 9. The number and positions of the mounting holes 4 correspond to those of the driving units. The mounting holes 4 can be used for accommodating the voice coil units and mounting and fixing the magnetic circuit units. The sound holes comprise two round central sound holes 7 and four edge sound holes 8 having an elongated shape. The central sound holes 7 are arranged between every four adjacent mounting holes 4. The number of the edge sound holes 8 is four, and the edge sound holes 8 are arranged between four sides of the annular side wall and the mounting holes 4, respectively. In the embodiment shown in FIG. 2, the edge sound holes 8 have an elongated shape, and the central sound holes 7 are round-shaped. Of course, the edge sound holes can be designed to be round or other irregular shapes according to the application requirement of the loudspeaker.

The upper side of the annular side wall 10 is fixedly connected with the folding ring part 2 of the vibration diaphragm. The driving units 5 are electrically connected by the FPCB connector 6. Multiple welding pads (not shown in FIG. 2) are arranged on the FPCB connector 6. The welding pads are connected with the voice coils and the external circuit.

The FPCB connector 6 is coupled to the vibration diaphragm and positioned at the same side as the voice coils of the driving units 5; the welding pads of the FPCB connector 6 are electrically connected with lead wires of the voice coils; and the end part of the FPCB connector 6 extends from the sound holes to one side of the mounting plane 9 away from the vibration diaphragm.

In the second embodiment of FIG. 2, six driving units are included, and the FPCB connector 6 has an elongated shape, the middle part of the FPCB connector is coupled to one side of the vibration diaphragm where voice coils are disposed, and two end parts of the FPCB connector extend to one side of the mounting plane away from the vibration diaphragm through the edge sound holes. During the process of connection, by using the circuit between welding spots, the voice coils can be connected in series, in parallel or be connected by a combination of series and parallel.

Besides, fixing holes are arranged on the thin edge of the housing 3. The fixing holes 11 are used for fixing the bass loudspeaker to electronic devices.

In the embodiments of FIG. 1 and FIG. 2, the dome part 1 of the vibration diaphragm is rigid which can improve the acoustic property of the vibration diaphragm. In the embodiment of the present invention, the dome part 1 of the vibration diaphragm can be made of light materials having good in rigidity such as a honeycomb structure or a foam body structure which can also improve the acoustic property of the vibration diaphragm. The folding ring part 2 of the vibration diaphragm is made of materials which are softer than the dome part 1, such as PU or silicon rubber, so that the vibration diaphragm can vibrate freely up and down.

In the embodiments of FIG. 1 and FIG. 2, the vibration diaphragm is rectangle or square in shape. However, according to specific application, the vibration diaphragm is not limited to rectangle, it can also be circular in shape. The number of driving units corresponding to the round vibration diaphragm is at least three. The included angle between two adjacent driving units and the center of a circle is 120 degrees. The number of driving units corresponding to the round vibration diaphragm can also be more, which will not be described in detail here.

As many driving units are used in the present invention, the driving units and the external circuit are electrically connected by the FPCB connector in the embodiment of the present invention. Compared with ordinary lead wire connecting, the present invention can simplify the manufacturing process, reduce the internal space of the loudspeaker and improve the stability of the loudspeaker by using the FPCB connector.

For the multiple driving units, to ensure that the FPCB connector can be conveniently fixed and combined with the housing as well as conveniently connect multiple voice coils, multiple welding pads and circuits connecting the welding pads are arranged on the surface of the FPCB connector, and the voice coils are electrically connected with the welding pads at one side of the FPCB connector closing to the vibration diaphragm through spot welding or the like. During connection, by using the circuit between welding spots, the voice coils can be connected in series, in parallel or be connected by a combination of series and parallel. Electronic devices (such as liquid crystal display television) are electrically connected with one side of the FPCB connector away from the mounting plane, and the FPCB connector is clamped and fixed on the mounting plane at the edge of the central sound holes, so that the limited internal space of the loudspeaker can be fully utilized.

Four of four or six driving units are respectively arranged on the vibration diaphragm corresponding to the edge of the dome part 1, which is beneficial to stable combination of the voice coils of the driving units 5 and the vibration diaphragm, preferably, positioned at four corners of the dome part 1, so that the vibration diaphragm can be driven in equilibrium. In such a configuration, small-size voice coil units and magnetic circuit units are used to drive the large-size vibration diaphragm of the bass loudspeaker, which can reduce the thickness of the bass loudspeaker and the size of magnets reducing the cost of the base loudspeaker, and improve the sensitivity of the bass loudspeaker. Such multiple driving units acting on the vibration diaphragm with uniform driving force can ensure enough driving power on the basis of reducing the size of the driving units, so that the products are more thinned. Such performance ensures that the flat plate-type bass loudspeaker of the present invention can be applied to electronic devices with high power, such as liquid crystal display television.

Figure 3:
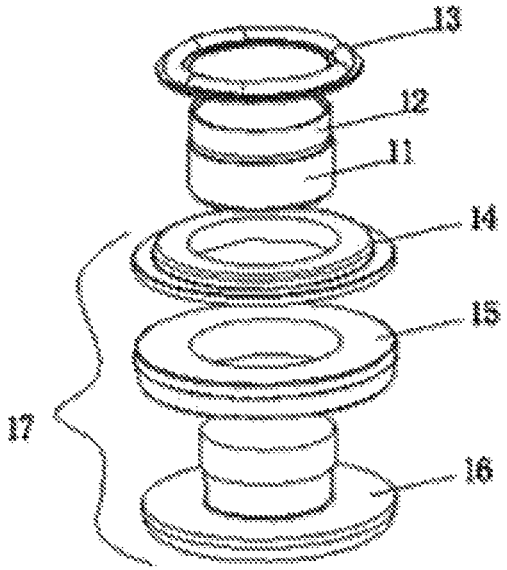
FIG. 3 is a structural schematic diagram of driving units according to the embodiment of the present invention.
Figure 4:
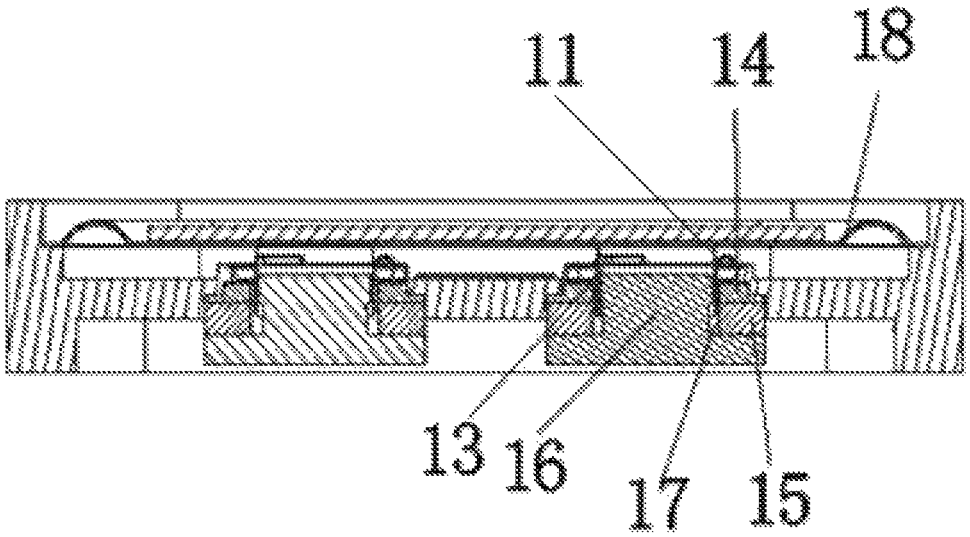
FIG. 4 is a sectional view of four driving units of the flat plate-type bass loudspeaker according to the first embodiment of the present invention.

FIG. 3 and FIG. 4 are structural schematic diagram and sectional view of driving units according to the embodiment of the present invention, respectively. As shown in FIG. 3 and FIG. 4, the driving unit comprises a voice coil unit and a magnetic circuit unit. Wherein, the voice coil unit comprises a voice coil 11, a voice coil bobbin 12 and a centering sheet 13, and the magnetic circuit unit comprises a washer 14, a magnet 15 and a T-shaped iron 16.

The top of the voice coil 11 and the vibration diaphragm 18 are combined and fixed. The voice coil bobbin 12 is used for supporting the voice coils 11, so that the voice coils 11 are at a proper position in the magnetic gap 17. The centering sheet 13 is used for fixing the voice coils 11 to prevent voice coils 11 from polarizing in the horizontal direction. Upon connecting electric signals, the voice coil unit vibrates under force in the magnetic circuit system, and the common vibration of multiple voice coil units drives the wide-diameter vibration diaphragm to vibrates so as to make sounds. In the present embodiment, the driving units independent from each other have the same size and performance, but are not limited to such a configuration. The configuration in which the large-size vibration diaphragm of the bass loudspeaker is driven by multiple small-size driving units can effectively reduce the thickness of the bass loudspeaker and adapt to the tendency for electronic products to be thinner, so that the bass loudspeaker of such configuration has stronger practicability.

The driving units in the embodiment shown in FIG. 3 and FIG. 4 are circular, which can ensure that the vibration diaphragm 18 is stressed more uniformly compared with rectangular voice coils. Both the washer 14 and the T-shaped iron 16 are guide magnetic for modifying magnetic lines; and the magnetic gap 17 formed between the magnet 15 and the T-shaped iron 16 is used for accommodating the voice coils 11.

Figure 5:
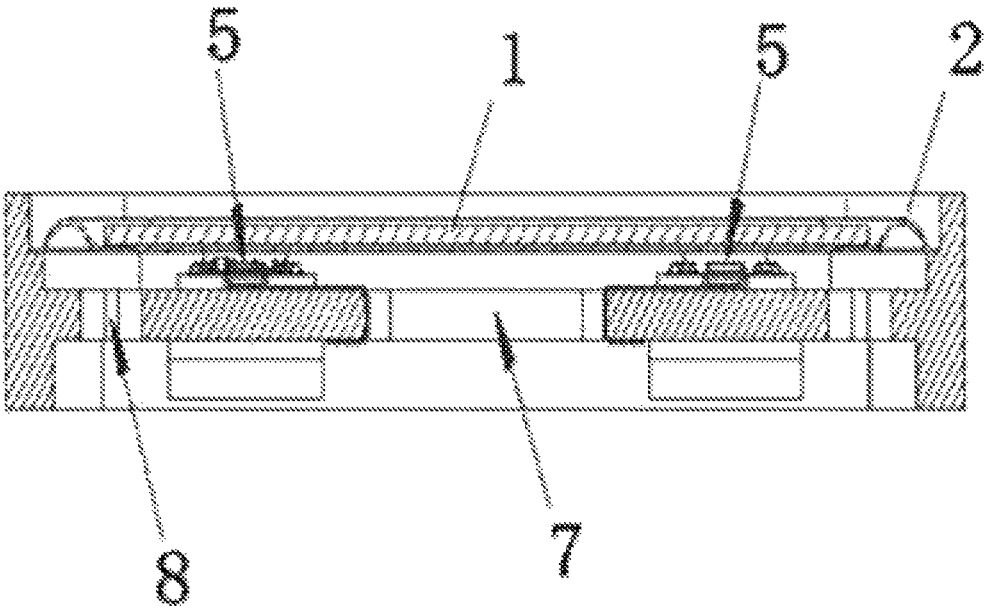
FIG. 5 is a sectional view from another angle of the bass loudspeaker according to the first embodiment of the present invention.

FIG. 5 is a sectional view from another angle (perpendicular to the extension direction of sound holes) of the bass loudspeaker according to the first embodiment. It can be seen in connection with FIG. 1, both the central sound hole 7 and the edge sound hole 8 have an elongated shaped. The diameter of the central sound hole 7 is larger than that of the edge sound hole 8, and area of the vibration diaphragm corresponding to the central sound hole 7 is also larger than that of the vibration diaphragm corresponding to the edge sound hole 8.

Such an arrangement of the sound holes can ensure that the airflow generated by vibration of the vibration diaphragm is transmitted to the surrounding in time through the sound holes so that the acoustic performance of the products can be ensured. The ratio of total area of the sound holes to area of the orthographic projection of the vibration diaphragm on the housing is less than 0.9, which can improve the smoothness of airflow, and enhance the acoustic performance of the bass loudspeaker. Wherein, the orthographic projection area of the vibration diaphragm on the housing is the orthographic projection area of the vibration diaphragm in the direction perpendicular to the vibration direction.

Besides, for the bass loudspeaker with four driving units in the first embodiment, area of the sound holes is relatively large, preferably, the ratio of total area of the sound holes to area of the orthographic projection of the vibration diaphragm on the housing is in a range of 0.2 to 0.6. For the bass loudspeaker with six driving units in the second embodiment, preferably, the ratio of total area of the sound holes to the orthographic projection area of the vibration diaphragm on the housing is within a numerical range of 0.1 to 0.4. Such a configuration can ensure the smoothness of airflow as well as the performances (such as strength and heat dissipation) of the housing.

Figure 6:
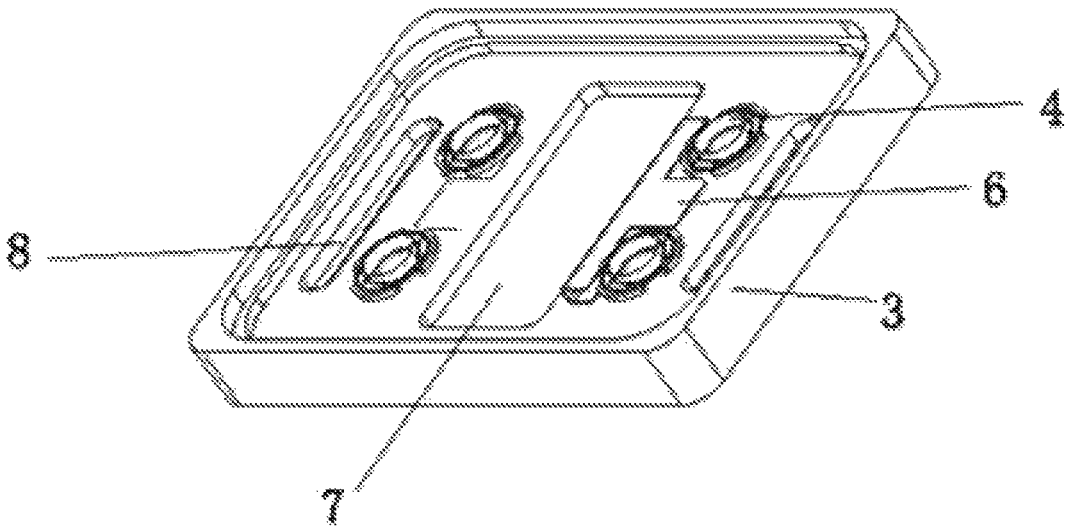
FIG. 6 is an back view of the housing of four driving units and driving units of the flat plate-type bass loudspeaker according to the first embodiment of the present invention.

FIG. 6 is a back view of the housing of four driving units and driving units of the flat plate-type bass loudspeaker according to the first embodiment of the present invention. As shown in FIG. 6, the housing 3 comprises a mounting plane and an annular side wall. Four mounting holes 4 for accommodating the driving units and sound holes are arranged on the mounting plane; wherein, the housing 3 is made of aluminum alloy materials which have high strength and good stability. The sound holes comprise a central sound hole 7 and edge sound holes 8.

In the embodiment shown in FIG. 6, the central sound hole 7 is arranged on the mounting plane corresponding to the intermediate region of the vibration diaphragm. For the rectangular vibration diaphragm, if four voice coils are arranged in the edge region, the intermediate region of the vibration diaphragm is relatively large, and this part of vibration diaphragm generates more airflow. Therefore, central sound hole 7 are arranged on the mounting plane corresponding to this part, and the size of the central sound hole 7 is large so that more airflow flows in or out from here. Besides, the edge sound holes 8 are arranged in the edge region of the mounting plane corresponding to the central sound hole 7.

The FPCB connector 6 is used for electrically connecting the driving units and the external circuit, and the FPCB connector 6 used in the present invention is rigid which has strong elasticity and is unlikely to be ruptured compared with the existing plastic materials.

Besides, fixing holes (not shown in FIG. 6) for fixing the bass loudspeaker and electronic devices are arranged at four corners of the housing 3.

Figure 7:
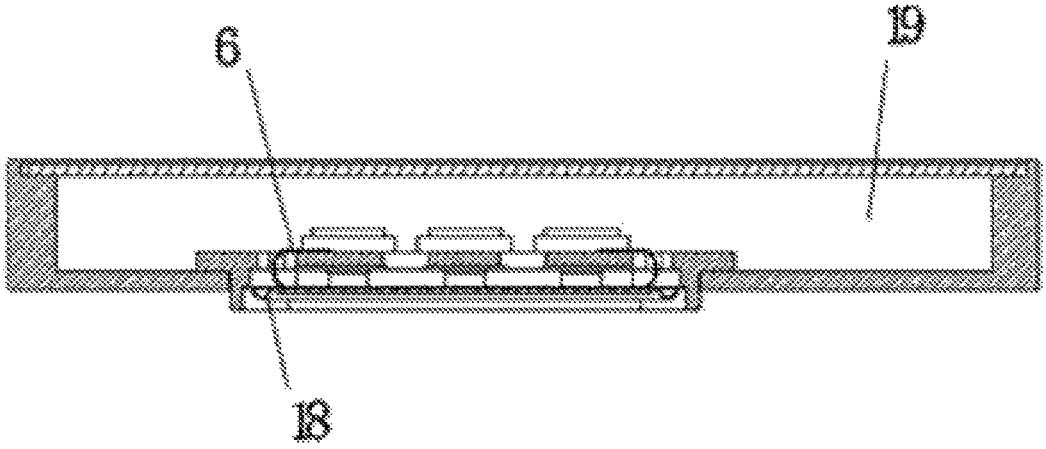
FIG. 7 is a diagram showing the operation state of the flat plate-type bass loudspeaker according to the first embodiment of the present invention.

FIG. 7 is an application state diagram of the flat plate-type bass loudspeaker according to the embodiment of the present invention.

As shown in FIG. 6, as the intermediate part of the FPCB connector 6 is coupled to one side of the vibration diaphragm where the voice coils are disposed, in the loudspeaker product, the intermediate part of the FPCB connector 6 is positioned at one side of the mounting plane closing to the vibration diaphragm, and two end parts of the FPCB connector 6 extend from the sound holes to one side of the mounting plane 9 away from the vibration diaphragm. The sound holes on the mounting plane ensure that the space of the rear side of the vibration diaphragm 18 is communicated with the rear acoustic cavity 19. Acoustic materials or gas adsorption materials can be added in the rear acoustic cavity 19. The acoustic materials can adjust the acoustic curve and the sound performance; and the gas adsorption materials can absorb gas and adjust the gas pressure of the rear acoustic cavity 19, so as to improve the equivalent volume of the rear acoustic cavity 19 and enhance the low-frequency sound effect of the products.

It can be seen from the aforementioned embodiment, in the flat plate-type bass loudspeaker provided by the present invention, at least three driving units are dispersedly arranged on the dome part of the vibration diaphragm; in the present invention, small-size voice coils and magnetic circuit system are used for driving the large-size vibration diaphragm of the bass loudspeaker, thus the thickness of the bass loudspeaker and the size of the magnet can be reduced, reducing cost and improving the sensitivity of the loudspeaker; at least three driving units act on the vibration diaphragm, the driving force is uniform, the driving power is ensured to be high enough, and the products are thin; the dome part of the vibration diaphragm generates more airflow, large sound holes are beneficial to air flowing and can increase the driving force of the loudspeaker; the housing is made of aluminum alloy materials which are high in strength and stability; and the FPCB is used for connecting the voice coils and the external circuit, so that the space can be saved.

As described above, the flat plate-type bass loudspeaker provided by the present invention is described by way of example with reference to the accompanying drawings. However, it should be understood by those skilled in the art that various improvements can be made to the flat plate-type speaker provided by the present invention as described above without depart from the contents of the present invention. Accordingly, the scope of protection of the present invention is defined by the contents of the appended claims.

What is claimed is:

1. A flat plate-type bass loudspeaker, comprising a flat plate-shaped vibration diaphragm, at least three driving units independent from each other and a housing for fixing and combining the vibration diaphragm and the driving units, wherein, each driving unit comprises a voice coil unit and a magnetic circuit unit corresponding to the voice coil unit, and the voice coil units are separately combined and fixed at one side of the vibration diaphragm closer to the housing, the vibration diaphragm comprising a rigid dome part at a central region and a folding ring part at an edge region, mounting holes for accommodating and fixing the magnetic circuit units, and sound holes penetrating through the housing and communicating with outside are arranged on the housing, the number and positions of the mounting holes corresponding to the number and positions of voice coil units attached to the dome part of the vibration diaphragm, wherein:

the housing comprises a mounting plane and an annular side wall arranged surrounding the mounting plane, a ratio of total area of the sound holes to area of the orthographic projection of the vibration diaphragm on the housing is in a range of 0.2 to 0.6, the sound holes comprise a central sound hole arranged at the central region of the mounting plane and an edge sound hole arranged at the edge region of the mounting plane, and, an area of the central sound hole is larger than an area of the edge sound hole.

2. The flat plate-type bass loudspeaker according to claim 1, wherein, the vibration diaphragm is rectangular in shape, and the voice coil units are fixed and combined to the dome part.

3. The flat plate-type bass loudspeaker according to claim 1, wherein, the mounting holes and the sound holes are arranged on the mounting plane, and an upper side of the annular side wall is coupled to the folding ring part of the vibration diaphragm.

4. The flat plate-type bass loudspeaker according to claim 1, wherein, the number of the driving units is four or six, wherein, at each of four corners of the dome part is disposed one of the voice coil units, respectively.

5. The flat plate-type bass loudspeaker according to claim 4, further comprising a FPCB connector electrically connecting an internal circuit and an external circuit of the bass loudspeaker, wherein, when the number of the driving units is four, the FPCB connector is T-shaped, clamped and fixed on the mounting plane at the edge of the central sound hole, one part of the FPCB connector is positioned at a side of the mounting plane closer to the vibration diaphragm, and other part of the FPCB connector is positioned at a side of the mounting plane away from the vibration diaphragm, and when the number of the driving units is six, the FPCB connector has an elongated shape, the middle part of the FPCB connector is coupled to a side of the vibration diaphragm where the voice coils are disposed, and two end parts of the FPCB connector extend to a side of the mounting plane away from the vibration diaphragm through the edge sound hole.

6. The flat plate-type bass loudspeaker according to claim 4, wherein, when the number of the driving units is six, the central sound hole is circular or square in shape, arranged between every four adjacent mounting holes, and the edge sound hole has an elongated shape, arranged between four sides of the annular side wall and the mounting holes, respectively.

7. The flat plate-type bass loudspeaker according to claim 1, wherein, the folding ring part is made of PU or silicon rubber, and the housing is made of an aluminum alloy material.

8. The flat plate-type bass loudspeaker according to claim 1, wherein, the periphery of the annular side wall is further provided with an extension part on which fixing holes for fixing the loudspeaker are uniformly arranged.

9. The flat plate-type bass loudspeaker according to claim 1, wherein, the voice coil unit comprises a centering sheet, a voice coil bobbin and a voice coil, and the upper surface of the mounting plane is provided with a position limiting part for limiting the centering sheet.

* * * * *